US008424635B1

(12) United States Patent
Klawunn

(10) Patent No.: US 8,424,635 B1
(45) Date of Patent: Apr. 23, 2013

(54) FIREARM SUPPRESSOR WITH RELATIONALLY-ROTATED SPACERS DISPOSED BETWEEN BAFFLES

(76) Inventor: Russell E. Klawunn, Tucson, AZ (US)

( * ) Notice: Subject to any disclaimer, the term of this patent is extended or adjusted under 35 U.S.C. 154(b) by 0 days.

(21) Appl. No.: 13/350,605

(22) Filed: Jan. 13, 2012

(51) Int. Cl.
*F41A 21/00* (2006.01)

(52) U.S. Cl.
USPC ..... 181/223; 181/227; 181/228; 181/264; 181/270; 181/281; 89/14.4

(58) Field of Classification Search ..... 181/223, 181/227, 228, 264, 270, 281; 89/14.4
See application file for complete search history.

(56) References Cited

U.S. PATENT DOCUMENTS

| | | | | |
|---|---|---|---|---|
| 2,727,584 | A * | 12/1955 | Marx | 181/270 |
| 4,167,987 | A * | 9/1979 | Turner | 181/235 |
| 8,002,080 | B1 * | 8/2011 | Bingham | 181/241 |
| 8,096,222 | B2 * | 1/2012 | Silvers | 89/14.4 |
| 8,167,084 | B1 * | 5/2012 | Moore | 181/223 |
| 2010/0163336 | A1 * | 7/2010 | Presz et al. | 181/223 |

* cited by examiner

*Primary Examiner* — Forrest M Phillips
(74) *Attorney, Agent, or Firm* — Kyle M. Pendergrass

(57) ABSTRACT

A firearm suppressor includes an outer housing and a baffle stack mounted inside the outer housing. The baffle stack includes baffles and spacers. The baffles and spacers are configured to allow a projectile to pass through while causing exhausted gas to flow through various chambers and channels in different directions.

11 Claims, 6 Drawing Sheets

Baffle orientation along longitudinal axis

Spacer shape along longitudinal axis between two baffles

FIREARM SUPPRESSOR WITH RELATIONALLY-ROTATED SPACERS DISPOSED BETWEEN BAFFLES

FIELD OF THE INVENTION

The present invention relates to sound suppression. In particular, the present invention relates to firearm suppressors having baffles separated by spacers that are rotationally oriented around a projectile pathway with respect to each other.

BACKGROUND OF THE INVENTION

Firearms typically discharge noise and gases into the atmosphere, when fired, which may be harmful or offensive to the shooter and/or to others within the general vicinity. As a result various suppression devices have been devised in order to attempt to solve this problem. These sound suppressor devices may feature baffles that use some form of asymmetry while others may feature the use of baffles that are basically symmetrical. While asymmetrical baffles typically produce high levels of turbulence within the sound suppressor, which aids in producing high levels of sound and flash reduction, asymmetrical baffles may result in some detrimental effects on the accuracy of the host firearm.

The concept behind the use of baffles is to divert gases away from a bore axis along which a projectile travels after leaving the muzzle of a firearm. The more effective the diversion, and subsequent creation of turbulence due to the diverting gases impinging upon other surfaces (e.g., spacers, gas flow channels and vent holes) within the suppressor, generally the suppressor is more efficient with regards to sound reduction.

SUMMARY OF THE INVENTION

In accordance with the present invention, a firearm suppressor may include an outer housing and a baffle stack that may be inserted and/or removed from the outer housing. The baffle stack may include three or more baffles that each have a proximal baffle surface and a distal baffle surface. A baffle bore sized to receive a projectile may extend through each baffle along a longitudinal axis. The firearm suppressor may further include two or more spacers that are each disposed between a respective set of two baffles. One spacer may be positioned along a first surface plane having a first orientation, and another spacer may be positioned along a second surface plane having a second orientation. The second surface plane may intersect the first surface plane along the longitudinal axis, and an acute angle may separate the first surface plane and the second surface plane. Additional spacers may be included, where the additional spacers are disposed between respective sets of two baffles and are oriented along respective surface planes that similarly intersect other surface planes along the longitudinal axis.

In accordance with the present invention, a firearm suppressor may include baffle stack including a first baffle, a second baffle, and a third baffle, each baffle including an opening defining a projectile aperture. The first, second, and third baffles may be coaxially positioned along a longitudinal axis defined by the projectile apertures. A first spacer may be connected between the first baffle and the second baffle, and a second spacer may be connected between the second baffle and the third baffle. The second spacer may be rotated about the longitudinal axis at an angle relative to the first spacer.

In accordance with the present invention, a method of manufacturing one or more firearm suppressor components includes the steps of forming all or a portion of three baffles with openings defining a projectile aperture. The baffles may be coaxially positioned along a longitudinal axis defined by the projectile apertures. A first spacer may be formed between a first baffle and a second baffle, and a second spacer may be formed between the second baffle and a third baffle. The orientation of the second spacer may be rotated about the longitudinal axis at an angle relative to the orientation of the first spacer.

BRIEF DESCRIPTION OF THE DRAWINGS

The present application may be more fully appreciated in connection with the following detailed description taken in conjunction with the accompanying drawings.

DETAILED DESCRIPTION OF THE INVENTION

Overview

One aspect of the disclosure relates to one or more components of a firearm suppressor. In one embodiment, a firearm suppressor may include three or more baffles, wherein each baffles has a proximal baffle surface and a distal baffle surface, and wherein a baffle bore extends through each baffle along a longitudinal axis. The firearm suppressor may further include two or more spacers. Each spacer may be disposed between a respective set of two baffles. One spacer may be positioned along a first surface plane having a first orientation, and another spacer may be positioned along a second surface plane having a second orientation. The second surface plane may intersect the first surface plane along the longitudinal axis, and an acute angle may separate the first surface plane and the second surface plane. Additional spacers may be included, where the additional spacers are disposed between respective sets of two baffles and are oriented along respective surface planes that similarly intersect other surface planes along the longitudinal axis.

Another aspect of the disclosure relates to gas flow through chambers formed by spacers with cut-out portions, through channels formed by surfaces of a spacer and two baffles, through vent holes, and through channels carved into a spacer that allow the gas to flow to/from chambers separated by two baffles and the spacer.

Another aspect of the disclosure relates to orientations and shapes of baffles and spacers in a three-dimensional space including a longitudinal axis.

Another aspect relates to manufacturing of one or more components of a firearm suppressor. In accordance with one embodiment regarding the manufacture of firearm suppressor components, several baffles may be formed with openings defining projectile apertures, and several spacers are formed, each between a respective set of the baffles. The baffles may be coaxially positioned along a longitudinal axis defined by the projectile apertures, and the orientation of one spacer is rotated about the longitudinal axis at an angle between zero (0) degrees and 360 degrees relative to the orientation of the first spacer.

Exemplary Embodiments

Certain features of the invention are depicted in the Figures.

Figure 1:
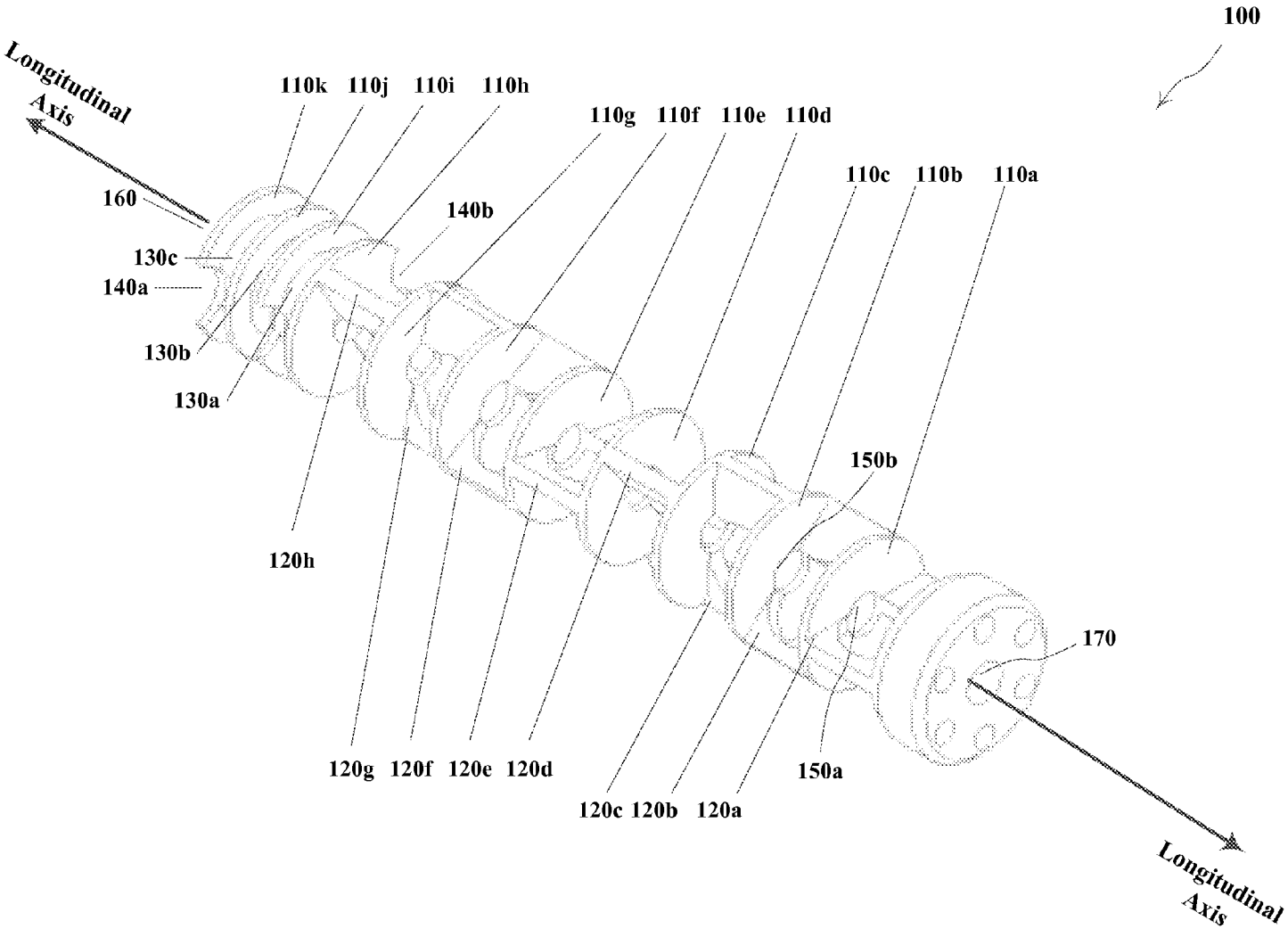
FIG. 1 depicts an isometric view of a baffle stack for one embodiment of a firearm suppressor.

Turning to FIG. 1, for example, an isometric view showing a baffle stack 100 of an embodiment of the present invention is illustrated. The baffle stack 100 may be formed as a single member (e.g., each part is milled from a piece of material or each piece is joined together using various techniques known in the art), or may be comprised of several members that are positioned next to each other.

As shown, the baffle stack 100 includes a plurality of baffles 110*a-k*, a plurality of relationally-rotated spacers 120*a-h*, a plurality of cylindrical spacers 130*a-c*, a plurality of venting holes (e.g., venting hole 140*a* and 140*b*), a plurality of bores/apertures sized larger than a projectile (e.g., bores 150*a* and 150*b*) through which a projectile (e.g., a bullet) travels along a longitudinal axis through the baffle stack 100 from a proximal end 160 to a distal end 170—e.g., through the center of the baffle stack 100 along the longitudinal axis. As will be illustrated in later figures, the any of the baffles 110 and spacers 120 may be formed or positioned at different orientations to those shown in FIG. 1. Moreover, any of the baffles 110 and spacers 120 may have different shapes, sizes and designs to those shown in FIG. 1. Later figures will illustrate additional features of the components depicted in FIG. 1 along with illustrations of other components not shown in FIG. 1.

As shown in FIG. 1, spacer 120*b* is positioned between baffle 110*a* and baffle 110*b* at a first orientation with respect to a three-dimensional space defined by the longitudinal axis, a lateral axis and a vertical axis. Spacer 120*c* is positioned between baffle 110*b* and baffle 110*c* at a second orientation with respect to the three-dimensional space. As shown, the second orientation is rotationally-offset around the longitudinal axis from the first orientation by an angle of rotation. The angle of rotation may be any angle from zero (0) degrees to 360 degrees. In a preferred embodiment, the angle of rotation may by approximately 137.5 degrees. In other embodiments, the angle of rotation may be selected from 20 degrees to 160 degrees, or from 200 degrees to 340 degrees.

Other spacers 120 are similarly rotated with respect to each other so that some spacers have different orientations than other spacers. Rotation of the spacers is a unique and advantageous feature of the invention, which provides structural strength while further dampening sound as compared to other suppressors. The different orientations of some spacers in relation to other spacers provide different gas flow characteristics over flow characteristics of other suppressors.

The spacers 120 in FIG. 1 are depicted as intersecting the longitudinal axis along respective bores (not labeled) that extend through the spacers from a respective distal end of one baffle to a respective proximal end of another baffle. Each of the spacers may be positioned along a respective surface plane that intersects the longitudinal axis. For example, spacer 120*a* may be positioned along a first surface plane that intersects the longitudinal axis, and spacer 120*b* may be positioned along a second surface plane that intersects the longitudinal axis. The second surface plane may be offset by any angle from the first surface plane (e.g., 137.5 degrees, or any angle between zero (0) degrees and 360 degrees). One of skill in the art will appreciate that the above surface planes, and therefore the spacers 120, need not intersect the longitudinal axis (i.e., the pathway of the bullet). Instead the spacers 120 may be offset from the bullet pathway, thereby eliminating any need to form the spacers 120 with respective bores to allow a projectile to pass through the spacers 120 as it travels from the proximal end 160 to the distal end 170.

FIG. 1 also illustrates a plurality of cylindrical spacers 130*a-c* that are formed or positioned between baffles 110*h-k*. Spacers 130*a-c* encircle the longitudinal axis, thereby creating a bore (not labeled) through which a projectile may travel. Gases emitted from the muzzle of the firearm may flow through channels formed by the outer wall of the spacers 130*a-c* and walls of the baffles 110-*h-k*. For example, gas may enter a first channel (not labeled) formed by the outer wall of spacer 130*a*, the distal wall of baffle 110*i*, and the proximal wall of baffle 110*h*. The gas may enter or exit through venting hole 140*b*. The same gas may flow through other channels formed by spacers 130*b-c* and baffles 110*i-k*, through various bores 150 of baffles 110*a-g*, and/or through various bores (not labeled) of spacers 120*a-h*.

Figure 2:
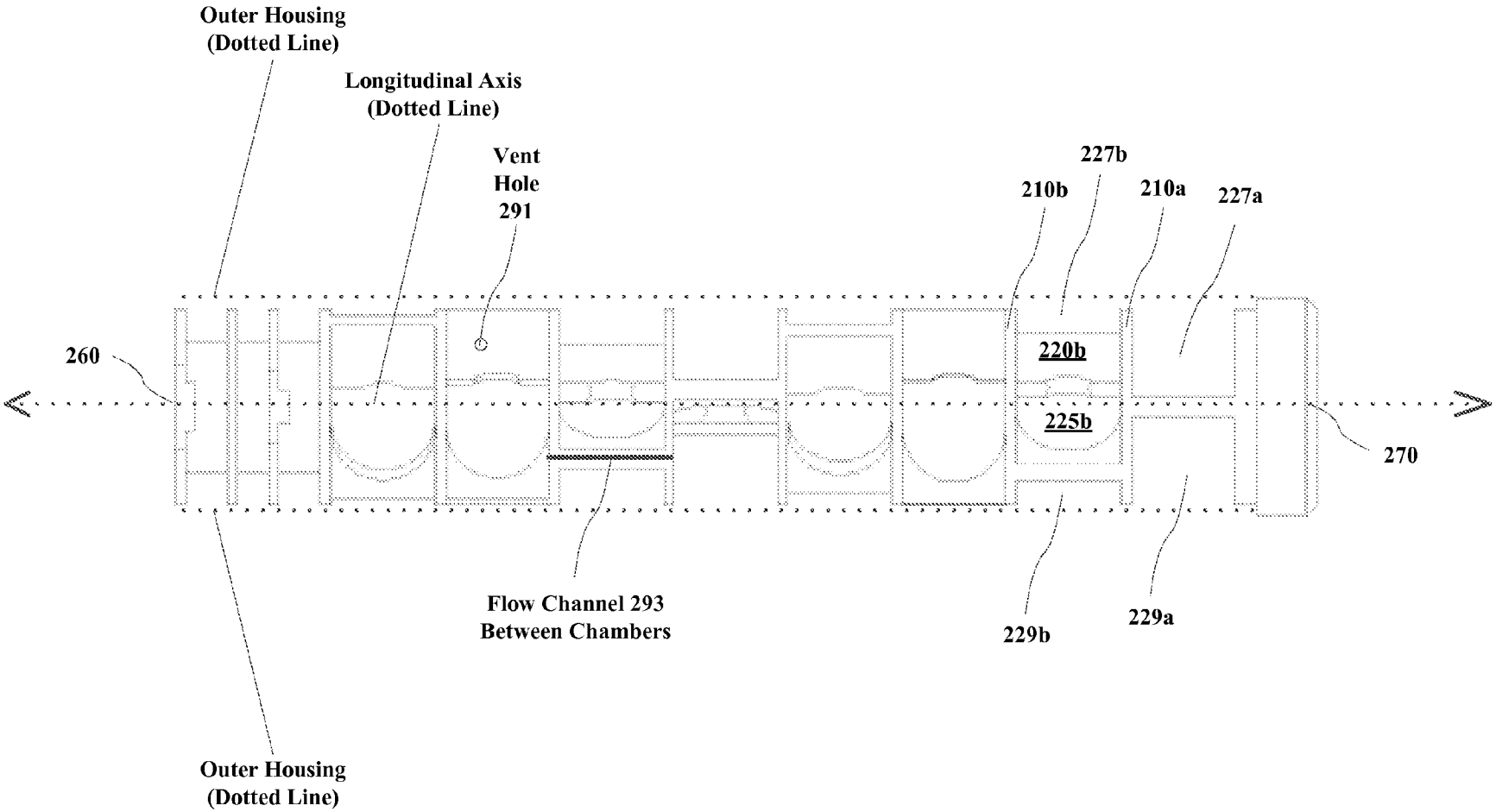
FIG. 2 depicts a sectional side view of a baffle stack.

Turning now to FIG. 2, which provides a sectional side view of a baffle stack 200. As shown, the baffle stack 200 includes baffles (e.g., baffles 210*a* and 210*b*) and spacers (e.g., spacer 220*b*). Spacer 220*b* includes a geometric cut-out 225*b* that joins chamber portions 227*b* and 229*b*, thereby forming one large chamber into which gas from a firearm may flow. The geometric cut-out 225*b* may take various shapes or combinations of shapes. Shapes may include any geometric shape, letter, number, image, or other design known in the art.

Figure 3:
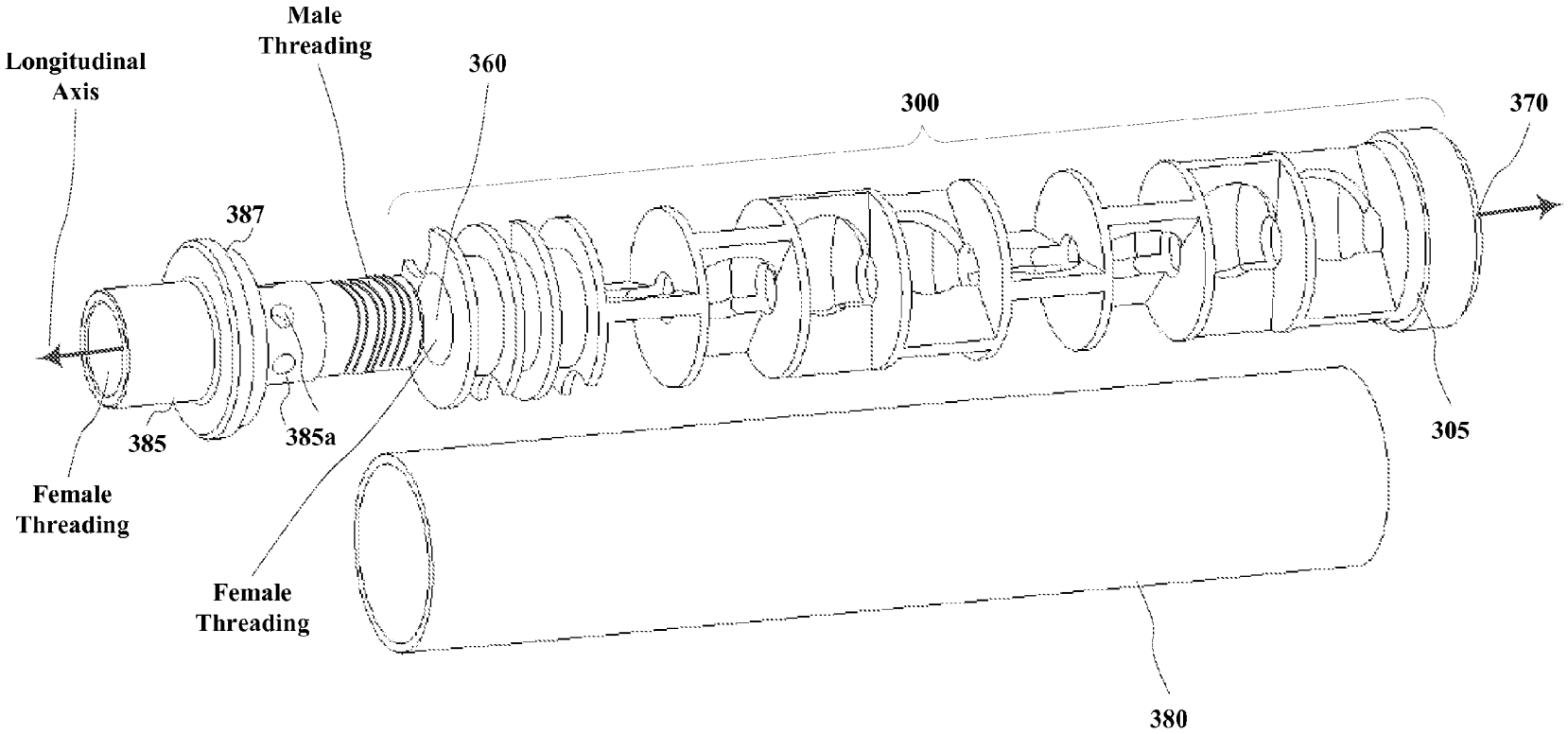
FIG. 3 depicts an exploded view of one embodiment of a firearm suppressor.

Attention is now drawn to FIG. 3, which depicts an isometric exploded view of a firearm suppressor in accordance with one embodiment. As shown, the suppressor includes a baffle stack 300, an outer tube 380 and a muzzle connector 385 with several vent holes 385*a*. The baffle stack 300 may slide inside the outer tube 380, and a portion of the muzzle connector 385 may slide into the proximal end 360 of the baffle stack 300.

The outer tube 380 may be held in compression between one indentation 305 (e.g., a machined indentation) of the baffle stack 300 and one indentation 387 (e.g., a machined indentation) of the muzzle connector 385. The outer tube 380 may be held in place when the baffle stack 300 (e.g., as a monocore component) screws into the muzzle connector 385 using female threading on the baffle stack near the proximal end 360 of the baffle stack 300, and male threading on the muzzle connector 385. The outer tube 380 may spin freely around the baffle stack 300 or may be held in place by a locking method (not shown, e.g., a screw that passes through the cylinder to contact the baffle stack 300 or the muzzle connector 385).

The muzzle connector 385, via female threading, may screw onto the end of a firearm barrel (not shown), which would include male threading.

Figure 4:
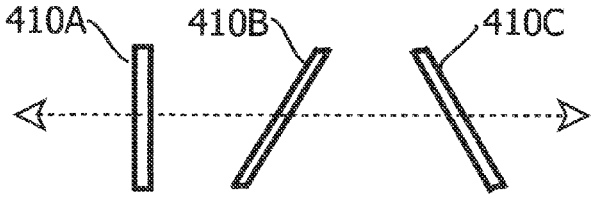
FIG. 4 illustrates different orientations of a baffle in accordance with one or more embodiments.
Figure 5:
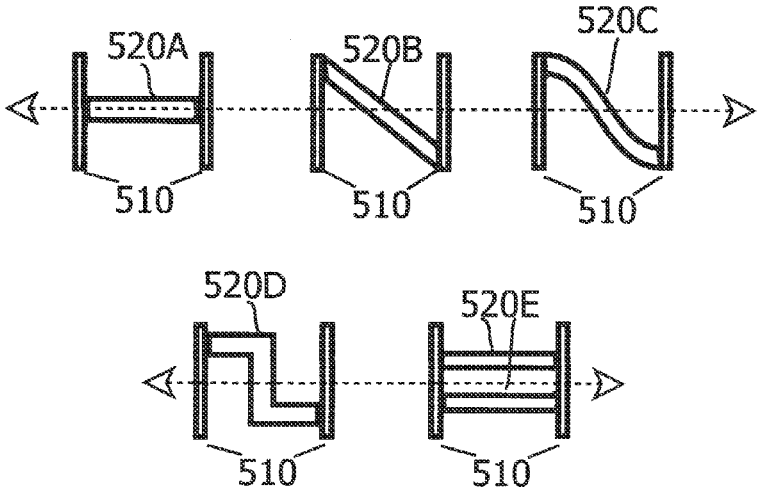
FIG. 5 illustrates different shapes of a spacer in accordance with one or more embodiments.

Turning now to FIGS. 4 and 5, which illustrate different configurations (e.g., orientation, shape, size) for a baffle and spacer, respectively. FIG. 4 illustrates different orientations of a baffle in accordance with one or more embodiments. In FIG. 1, baffles 110 are perpendicular (i.e., at right angles) to the longitudinal axis. However, one of skill in the art will appreciate that other angles (e.g., acute and obtuse angles) are possible. One of skill will also understand that a baffle may have any orientation within a three-dimensional space—e.g., a baffle may be rotated about a lateral axis and/or a vertical axis to achieve a different orientation than that shown in FIG. 1.

A baffle may also have different shapes beyond the washer shape baffles 110 shown in FIG. 1, and may include additional cut-outs beyond the bores 150. Moreover, either or both of the proximal and distal surfaces of a baffle may be flat, curved, stepped, saw-toothed, or have any geometric surface shape or structure known in the art (e.g., indentations, dimples, grooves, etc). The proximal and distal ends may also be coated with known coatings.

FIG. 5 illustrates different shapes of a spacer 520 between two baffles 510 in accordance with one or more embodiments. As shown, a spacer 520 may be parallel with the longitudinal axis (e.g., see A in FIG. 5, and as shown in FIG. 1). A spacer 520 may alternatively diagonal to or curved about the longitudinal axis (e.g., see B-C in FIG. 5, respectively). A spacer 520 may also be stepped relative to the longitudinal axis (e.g., see D in FIG. 5), or may be helical about the longitudinal axis (not shown). Alternatively, two spacers 520 may be positioned between the same baffles, parallel to each other and at an any shape shown in FIG. 5 or otherwise described herein (e.g., see E in FIG. 5). Although the baffles 510 are shown to be perpendicular to the longitudinal axis, one of skill in the art will appreciate that the baffles can be in an orientation described herein, including those in FIG. 4.

Figure 6A:
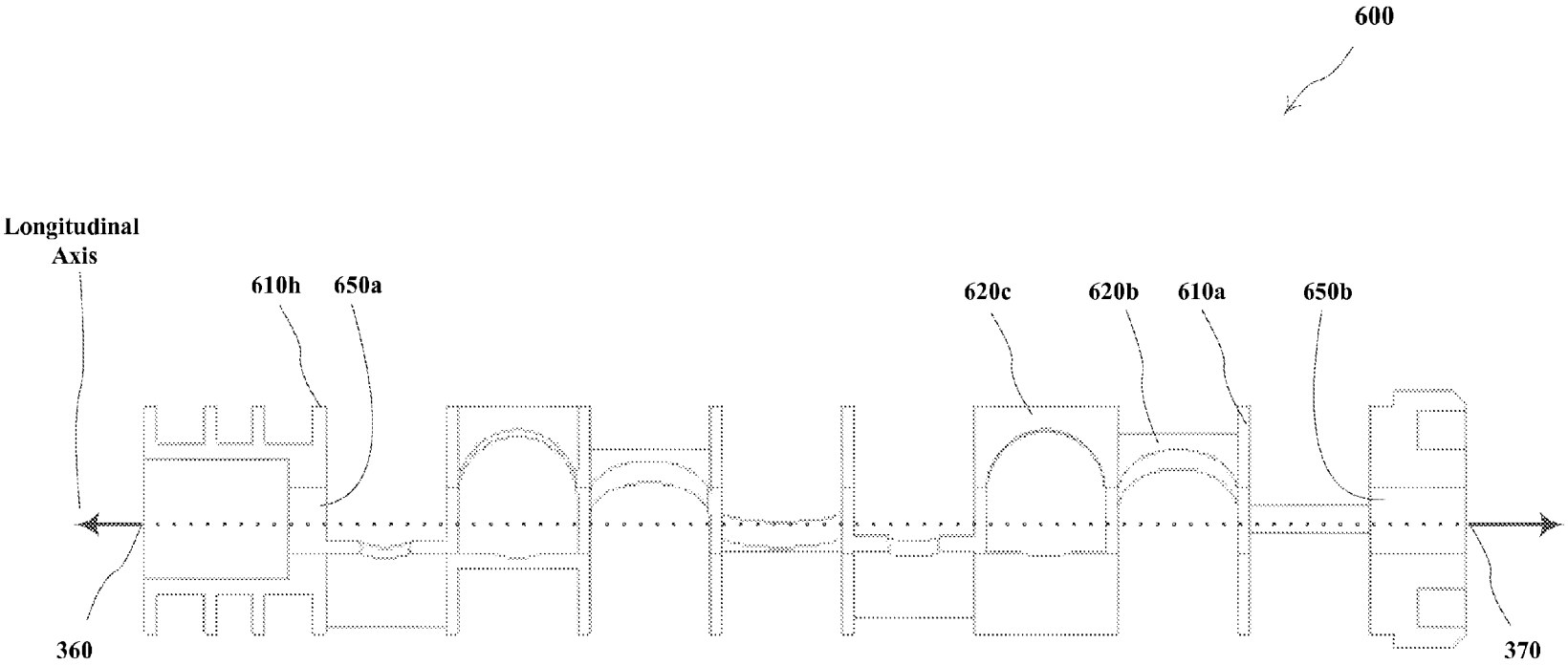
FIG. 6A illustrates a cross-sectional, side view of a baffle stack.
Figure 6B:
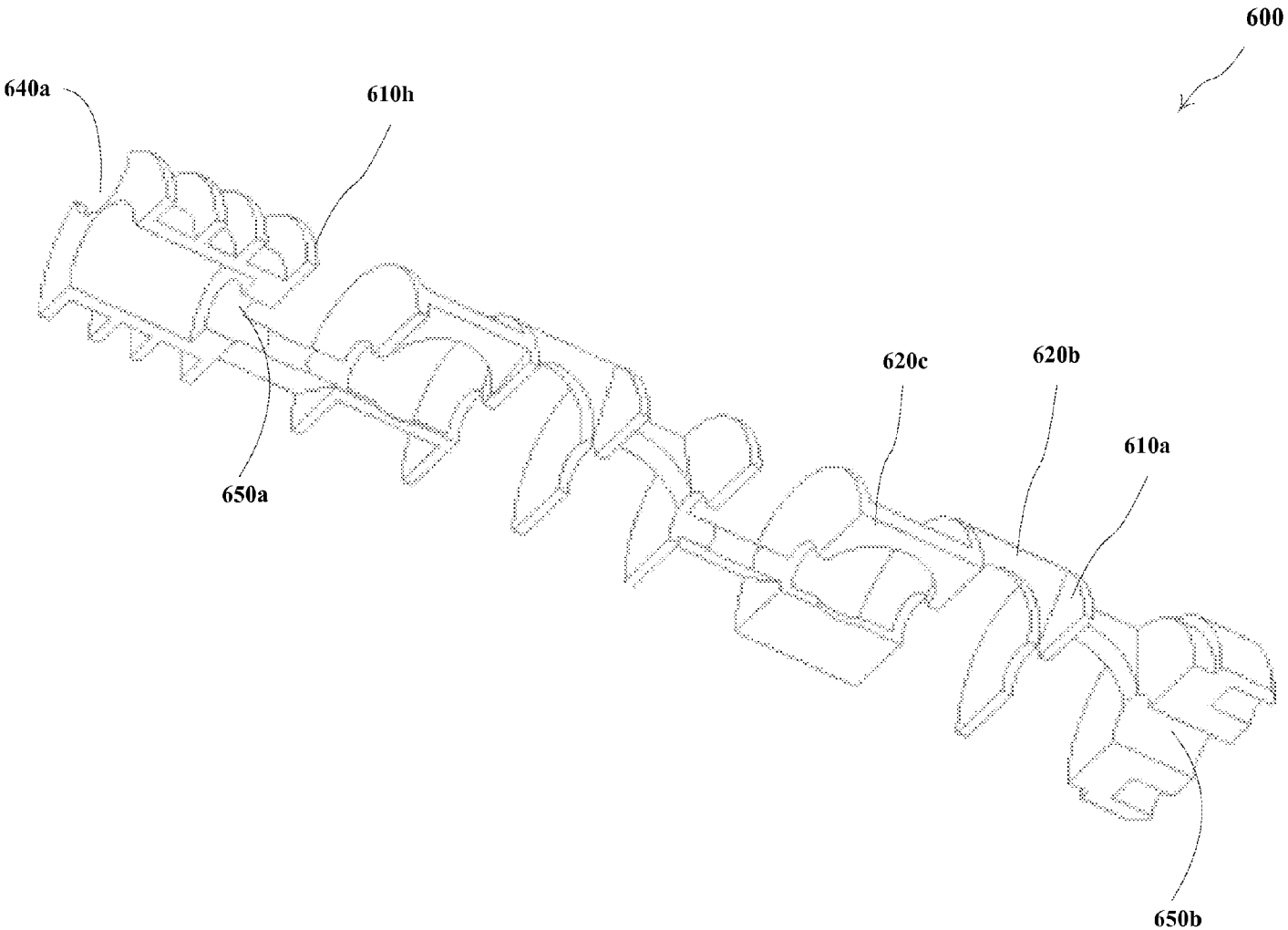
FIG. 6B illustrates a cross-sectional, isometric view of a baffle stack.

Turning now to FIGS. 6A and 6B, which illustrate side and isometric cross-sectional view of a baffle stack 600, respectively. As illustrated, the longitudinal axis extends along a bore axis that includes several bores, including bores 650*a* and 650*b*. The baffle stack 600 includes several baffles, including baffles 610*a* and 610*h*. The baffle stack 600 further includes several spacers, including spacers 620*b* and 620*c*. As shown, some or all of the spacers are positioned at different orientations around the longitudinal axis.

The components described herein may be made from any suitable material, including metals, metal alloys, plastics, and other materials capable of necessary heat transfer, sound absorption, durability and other factors appreciated by those skilled in the art. Manufacture of embodiments described herein may include milling single pieces of material into the components, molding the components, welding the components together, or other methods appreciated by those skilled in the art.

It is understood that the specific order, dimension, shape and other characteristics of components disclosed herein are examples of exemplary apparatuses, methods of manufacturing apparatuses, and methods of assembling apparatuses, among other approaches. Based upon design preferences, it is understood that the specific order components may be rearranged while remaining within the scope of the present disclosure unless noted otherwise. It is further noted that any of the concepts described herein can be used in combination with each other even if that combination is not explicitly described herein. The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The disclosure is not intended to be limited to the aspects shown herein, but is to be accorded the full scope consistent with the specification and drawings, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

While various embodiments of the present firearm suppressor and its components have been described in detail, it will be apparent to those skilled in the art that the present invention can be embodied in various other forms not specifically described herein. The innovative structures described herein are applicable to a wide variety of sound suppression apparatuses and circumstances besides a firearm suppressor. Therefore, the protection afforded the present invention should only be limited in accordance with the following claims.

I claim:

1. A firearm suppressor, comprising a baffle module comprising:

a first baffle, a second baffle, and a third baffle, each baffle including an opening defining a projectile aperture, wherein the first, second, and third baffles are coaxially positioned along a longitudinal axis defined by the projectile apertures;

a first spacer connected between the first baffle and the second baffle;

a second spacer connected between the second baffle and the third baffle, wherein the second spacer is rotated about the longitudinal axis at an angle between 10 degrees and 170 degrees relative to the first spacer.

2. The firearm suppressor of claim 1, further comprising:

an outer housing defining a longitudinal interior volume, the outer housing including a first end and a second end, wherein a projectile path extends from the first end to the second end through the longitudinal interior volume.

3. The firearm suppressor of claim 1, further comprising:

a fourth baffle; and a third spacer connected between the third baffle and the fourth baffle, wherein the second spacer is rotated about the longitudinal axis at an angle between 10 degrees and 170 degrees relative to the first spacer, and the third spacer is rotated about the longitudinal axis at an angle between 10 degrees and 170 degrees relative to the second spacer.

4. A method of manufacturing one or more firearm suppressor components, comprising:

forming all or a portion of a first baffle, a second baffle, and a third baffle, each baffle formed with an opening defining a projectile aperture, wherein the first, second, and third baffles are coaxially positioned along a longitudinal axis defined by the projectile apertures;

forming a first spacer between the first baffle and the second baffle;

forming a second spacer between the second baffle and the third baffle, wherein the orientation of the second spacer is rotated about the longitudinal axis at an angle between 10 degrees and 170 degrees relative to the orientation of the first spacer.

5. The firearm suppressor of claim 1, wherein the second spacer is rotated about the longitudinal axis at an angle between 20 and 70 degrees or 110 to 160 degrees relative to the first spacer.

6. The firearm suppressor of claim 5, further comprising:

a fourth baffle; and a third spacer connected between the third baffle and the fourth baffle, wherein the second spacer is rotated about the longitudinal axis at an angle between 110 degrees and 160 degrees relative to the first spacer, wherein the third spacer is rotated about the longitudinal axis at an angle between 110 to 160 degrees relative to the second spacer, and wherein the third spacer is rotated about the longitudinal axis at an angle between 110 to 140 degrees relative to the first spacer.

7. The firearm suppressor of claim 1, wherein the first spacer and the second spacer are substantially the same size.

8. The firearm suppressor of claim 1, wherein the first baffle, the first spacer, the second baffle, the second spacer, and the third baffle are formed as a single-member firearm suppressor core.

9. The method of manufacturing of claim 4, further comprising:

forming an outer housing defining a longitudinal interior volume, the outer housing including a first end and a second end, wherein a projectile path extends from the first end to the second end through the longitudinal interior volume.

10. The method of manufacturing of claim 4, wherein the second spacer is rotated about the longitudinal axis at an angle between 20 and 70 degrees or 110 to 160 degrees relative to the first spacer.

11. The method of manufacturing of claim 4, wherein the first baffle, the first spacer, the second baffle, the second spacer, and the third baffle are formed as a single-member firearm suppressor core.

* * * * *